US008382253B1

(12) United States Patent
Rivas et al.

(10) Patent No.: US 8,382,253 B1
(45) Date of Patent: Feb. 26, 2013

(54) FLUID EJECTION DEVICE AND METHODS OF FABRICATION

(75) Inventors: Rio Rivas, Corvallis, OR (US); Minalben Bhavin Shah, Corvallis, OR (US); Henry Kang, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/217,307

(22) Filed: Aug. 25, 2011

(51) Int. Cl.
*B41J 2/05* (2006.01)

(52) U.S. Cl. ..... 347/56

(58) Field of Classification Search ..... 347/20, 347/40, 54, 56, 61, 62
See application file for complete search history.

(56) References Cited

U.S. PATENT DOCUMENTS

| | | | |
|---|---|---|---|
| 6,648,732 | B2 | 11/2003 | Pugliese, Jr. et al. |
| 6,902,867 | B2 | 6/2005 | Hall et al. |
| 6,918,657 | B2 | 7/2005 | Kawamura et al. |
| 2010/0085402 | A1 | 4/2010 | Silverbrook |
| 2011/0049092 | A1 | 3/2011 | Pan et al. |

*Primary Examiner* — An Do
(74) *Attorney, Agent, or Firm* — Nathan R. Rieth

(57) ABSTRACT

In an embodiment, a fluid ejection device includes a die including a fluid feed slot that extends from a back side to a front side of the die, a firing chamber formed on the front side to receive fluid from the feed slot, a fluid distribution manifold adhered to the back side to provide fluid to the feed slot, and a corrosion-resistant layer coating the back side of the die so as not to extend into the feed slot.

6 Claims, 6 Drawing Sheets

FLUID EJECTION DEVICE AND METHODS OF FABRICATION

BACKGROUND

Printheads are examples of fluid ejection devices used in printing systems to selectively deposit fluid, such as ink, onto print media. Over time, ink used in a printhead fluid ejection device can cause degradation of the device and reduce print quality from the printing system. The inks used in fluid ejection devices are typically pigment-based inks or dye-based inks. While dye inks have a wider color gamut than pigment inks, pigment inks are generally preferred because they are more color-fast (i.e., more permanent) than dye inks. However, continuing efforts to enhance the performance of pigment inks (e.g., through chemical manipulation) have increased pH levels within the inks and made them more corrosive. Thus, as the performance of pigment inks improves, so too does the aggressiveness with which they corrode fluid ejection devices and cause reduced print quality in printing systems.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
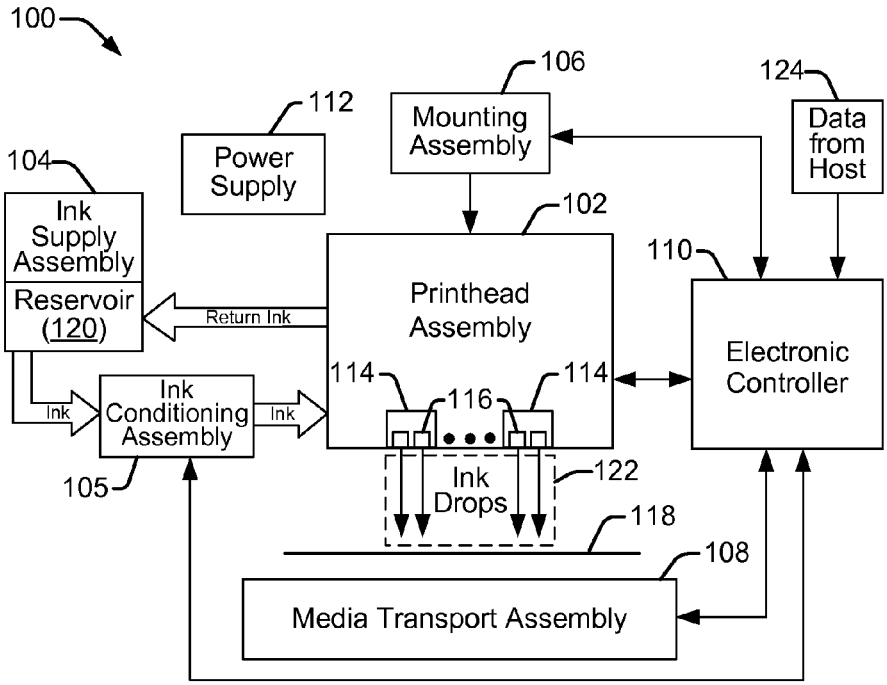
FIG. 1 shows an inkjet printing system suitable for incorporating a fluid ejection device with a die substrate having a corrosion-resistant backside layer as disclosed herein, according to an embodiment.

As noted above, high-performing pigment inks have increased pH levels that contribute to corrosion of fluid ejection devices (e.g., printheads) in printing systems such as inkjet printers. Printhead fluid ejection devices are microelectromechanical systems (MEMS) devices that generally include a microfluidic architecture driven by microelectronic components. The microfluidic architecture includes chambers with corresponding nozzles through which ink drops are ejected. The chambers and nozzles can be formed from layers of polymeric materials such as SU8. The microfluidic architecture also includes a semiconductor substrate (i.e., a silicon die substrate cut from a wafer) with a front side on which the chamber and nozzle layers are formed. Microelectronic components, such as thermal resistors, are also formed on the front side of the substrate and function as ejection elements to heat the ink in chambers and form vapor bubbles that force ink out through corresponding nozzles. The substrate also has a back side through which ink flows into the fluid feed slots and then into the chambers. Ink flows into the fluid feed slots from a fluid distribution manifold adhered to the back side of the substrate.

MEMS devices, such as a fluidic ejection device in an inkjet printer, can be produced using a combination of wet etch and dry etch processes to etch silicon from substrates (i.e., silicon die substrates cut from a wafer) on which the devices are fabricated. An etch mask that resists etching can be used to protect parts of the substrate from the etchant. The mask enables a selective etch that prevents or reduces etching from undesired areas of the substrate. In some types of etching processes, a typical photoresist masking material may not be durable enough to withstand the chemistries used in the wet or dry etching processes. In such cases a more durable mask such as silicon nitride (SiN) can be used as a hard mask material. For example, a SiN layer can be used on the back side of the silicon substrate as a silicon wet etch mask when forming the fluid feed slots of a fluid ejection device. After the slot formation, the fluid distribution manifold can be adhered to the SiN layer on the back side of the substrate.

However, while SiN serves as an adequate wet etch mask during formation of fluid feed slots in a semiconductor substrate (i.e., a silicon die substrate cut from a wafer), it is not robust enough to withstand lengthy exposure to some inks, such as high-performing pigment inks that are often used in fluid ejection devices. Corrosion of the SiN layer at the adhesive joint between the back side of the substrate and the fluid distribution manifold can degrade the joint and cause fluidic crosstalk between fluid feed slots resulting in, for example, the mixing of different colored inks between the slots. The reliability of the adhesive joint between the substrate and the fluid distribution manifold is therefore dependent on the rate at which the ink etches away the backside SiN, rather than the width of the adhesive bondline itself.

Embodiments of the present disclosure provide a fluid ejection device and fabrication methods that employ a robust material on the back side of a silicon substrate (i.e., a silicon die substrate cut from a wafer) that resists the corrosive effects of inks such as high-performing, high-pH, pigmented inks. Use of a corrosive-resistant material on the substrate backside increases the reliability of the adhesive joint between the substrate and fluid distribution manifold. This improves the reliability of the fluid ejection device and/or enables a reduction in the width of the adhesive bondline forming the joint.

In one embodiment, a fluid ejection device includes a die having a fluid feed slot that extends from a back side to a front side of the die. A firing chamber is formed on the front side of the die to receive fluid from the fluid feed slot. A fluid distribution manifold is adhered to the back side of the die to provide fluid to the fluid feed slot. A corrosion-resistant layer coats the back side of the die so as not to extend into the fluid feed slot. In one implementation, the corrosion-resistant layer comprises tantalum.

In another embodiment, a method of fabricating a fluid ejection device includes growing a silicon dioxide (SiO2) layer on at least the back side of a silicon wafer substrate. The method includes forming a silicon nitride (SiN) layer on at least the SiO2 layer on the back side of the wafer substrate. The method then includes removing the SiN layer from the backside of the wafer substrate and forming a tantalum layer on the back side of the wafer substrate. A fluid feed slot is then formed in the wafer substrate that extends from the back side of the substrate to the front side of the substrate.

In another embodiment, a method of fabricating a fluid ejection device includes growing an SiO2 layer on the front side and the back side of a silicon wafer substrate, and forming an SiN layer on the SiO2 layers on the front side and back side of the wafer substrate. The method includes removing the SiN layer from the backside of the wafer substrate and forming a tantalum layer on the back side of the wafer substrate. In one implementation, the method includes removing both the SiN and SiO2 layers from the backside and forming a tantalum layer on the back side of the wafer substrate. The backside SiN and SiO2 layers can be removed, for example, with dry etch steps or with a backgrind process that also reduces the thickness of the wafer substrate. Functional components are formed on the front side of the wafer substrate, and a fluid feed slot is formed in the wafer substrate that extends from the back side to the front side of the wafer substrate.

Illustrative Embodiments

FIG. 1 illustrates an inkjet printing system 100 suitable for incorporating a fluid ejection device with a die substrate having a corrosion-resistant backside layer as disclosed herein, according to an embodiment. In this embodiment, the fluid ejection device is disclosed as a fluid drop jetting printhead 114. Inkjet printing system 100 includes an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one printhead 114 that ejects drops of ink through a plurality of orifices or nozzles 116 toward a print medium 118 so as to print onto print medium 118. Print media 118 can be any type of suitable sheet or roll material, such as paper, card stock, transparencies, Mylar, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, ink supply assembly 104 supplies ink under positive pressure through an ink conditioning assembly 105 to inkjet printhead assembly 102 via an interface connection, such as a supply tube. Ink supply assembly 104 includes, for example, a reservoir 120, pumps and pressure regulators (not specifically illustrated). Reservoir 120 may be removed, replaced, and/or refilled. Conditioning in the ink conditioning assembly 105 may include filtering, pre-heating, pressure surge absorption, and degassing. During normal operation of printing system 100, ink is drawn under negative pressure from the printhead assembly 102 to the ink supply assembly 104. The pressure difference between the inlet and outlet to the printhead assembly 102 provides an appropriate backpressure at the nozzles 116, which is usually on the order of between negative 1" and negative 10" of H2O.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108 while media transport assembly 108 positions print media 118 relative to inkjet printhead assembly 102.

Electronic controller 110 typically includes a processor, firmware, and other printer electronics for communicating with and controlling inkjet printhead assembly 102, mounting assembly 106, and media transport assembly 108. Electronic controller 110 receives data 124 from a host system, such as a computer, and includes memory for temporarily storing data 124. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic controller 110 controls inkjet printhead assembly 102 for ejection of ink drops from nozzles 116. Thus, electronic controller 110 defines a pattern of ejected ink drops which form characters, symbols, and/or other graphics or images on print medium 118. The pattern of ejected ink drops is determined by the print job commands and/or command parameters from data 124.

In the described embodiments, inkjet printing system 100 is a drop-on-demand thermal inkjet printing system with a thermal inkjet (TIJ) printhead 114 (fluid ejection device) suitable for incorporating a robust material on the back side of the silicon wafer/die substrate that resists the corrosive effects of inks such as high-performing, high-pH, pigmented inks. In one implementation, inkjet printhead assembly 102 includes a single TIJ printhead 114. In another implementation, inkjet printhead assembly 102 includes a wide array of TIJ printheads 114. While the fabrication processes associated with TIJ printheads are well suited to the incorporation of the disclosed corrosion-resistant backside die layer, other printhead types such as a piezoelectric printhead can also incorporate such material. Thus, the disclosed embodiments are not limited to implementation in a TIJ printhead 114.

Figure 2:
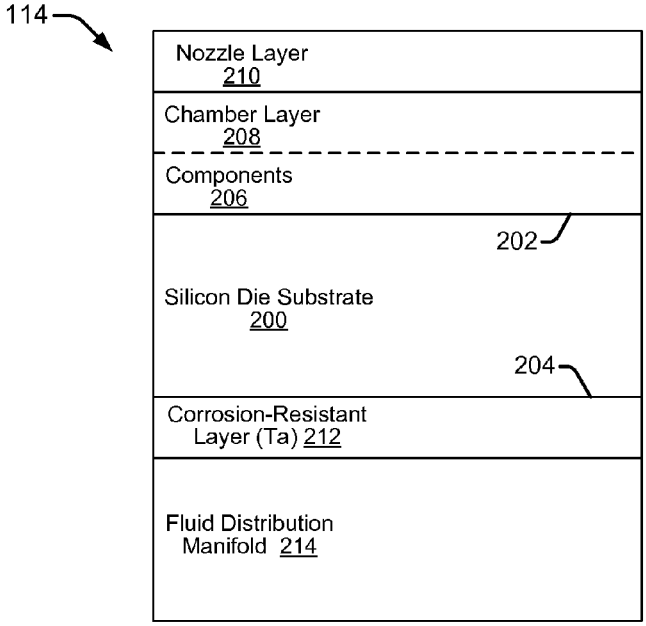
FIG. 2 shows a block layer representation of a MEMS device embodied as a TIJ printhead (fluid ejection device), according to an embodiment.

FIG. 2 shows a block layer representation of a MEMS device embodied as a TIJ printhead 114 (fluid ejection device), according to an embodiment of the disclosure. The printhead 114 includes a silicon die substrate 200 cut from a silicon wafer. It is noted that the phrases "wafer substrate" and die substrate" are used throughout the disclosure to refer generally to a silicon substrate that may be in various stages of fabrication, with the understanding that the substrate is initially processed in wafer form and then is ultimately separated (i.e., cut or sawn, etc.) into a plurality of separate die substrates that are each individually used in the final fabrication of a printhead 114. As shown in FIG. 2, the die substrate 200 has a front side 202 and a back side 204. The front side 202 is a component side on which functional components 206 and fluidic features of the printhead 114 are formed. The components 206 include semiconductor devices such as thermal resistors that act as ejection elements to eject fluid drops from the printhead 114 through corresponding nozzles 116. A thermal resistor element (not shown in FIG. 2) is generally fabricated on the die substrate 200 as a thin film stack that includes, for example, an oxide layer, a metal layer defining the thermal resistor element, conductive traces, and a passivation layer.

Fluidic features on the front side 202 of the die substrate 200 include a chamber layer 208 in which fluidic firing chambers are formed over corresponding thermal resistors (ejection elements). The chamber layer 208 is formed, for example, of a polymeric material such as SU8 commonly used in the fabrication of microfluidics and MEMS devices. Although the entire chamber layer 208 is shown in FIG. 2 as being above the component layer 206, it is actually formed on or adjacent to the substrate 200 except in areas where chambers are formed over corresponding thermal resistors fabricated on the substrate 200. This is represented in FIG. 2 by the dashed line shown between the chamber layer 208 and component layer 206. A nozzle layer 210 is formed on the chamber layer 208 and includes nozzles (not shown) that each correspond with a respective chamber and thermal resistor ejection element (not shown).

The back side 204 of the die substrate 200 is opposite the front side 202. Components are generally not fabricated on the back side 204 of the substrate 200. The printhead 114 includes a corrosion-resistant layer 212 on the back side 204 of the substrate 200. A corrosion-resistant layer in this context is intended to indicate a layer that resists corrosive etching by fluid inks commonly used within the printhead 114. Such inks may include, for example, dye-based and pigment-based inks, but more specifically may include higher-performing pigment-based inks having increased pH levels that cause them to be more corrosive than typical dye-based inks. In this embodiment the corrosion-resistant layer 212 on the back side 204 of the substrate 200 is a tantalum (Ta) layer 212. However, the corrosion-resistant layer 212 may not be limited to a tantalum layer, and in some embodiments may include layers formed of other materials such as different metals, metal alloys, metal oxides, metal nitrides, silicon carbide, ceramics, dielectrics, silicon oxide, semiconductors, composites, organic and inorganic compounds, polymers and carbon fluorine complex polymers, and other suitable materials resistant to the corrosive effects of inks such as higher-performing, pigment-based inks having increased pH levels.

The corrosion-resistant tantalum (Ta) layer 212 may act as a hard mask during fabrication of the printhead 114. In addition, the film stress of the tantalum layer 212 reduces bowing of the silicon die substrate 200 compared to other mask materials (e.g., silicon nitride) that may be employed as a mask for etching. Less bowing of the substrate 200 reduces stress that may otherwise cause cracks in the substrate 200. The strength of the tantalum layer 212 also reduces the size of break-off artifacts.

Figure 3:
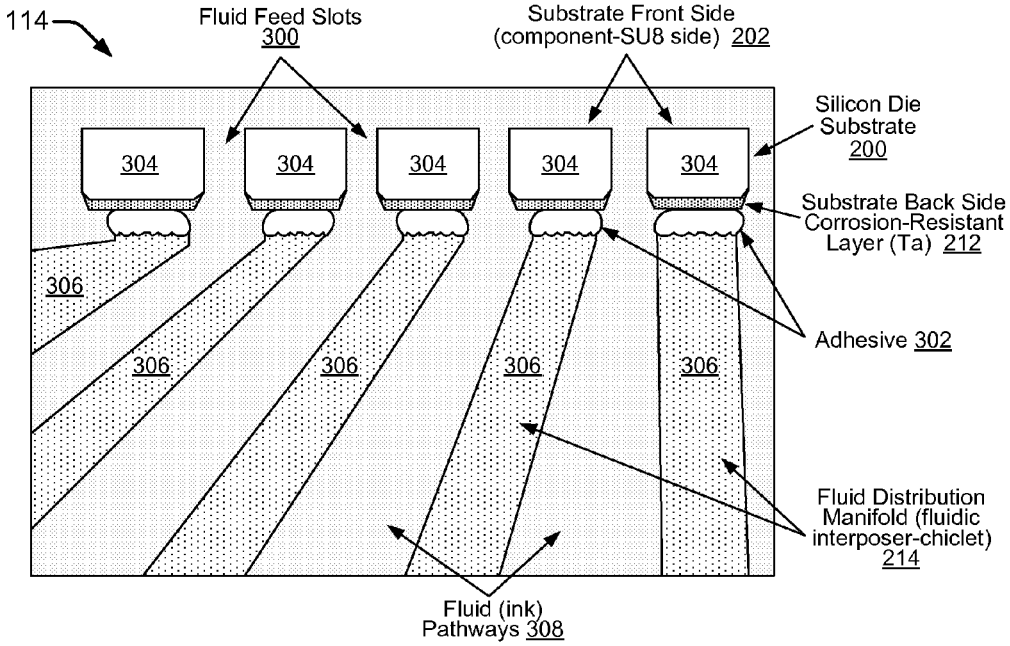
FIG. 3 shows a cross-sectional view of a die substrate adhered to a fluid distribution manifold (i.e., a plastic fluidic interposer, or chiclet) in a printhead fluid ejection device, according to an embodiment.
Figure 4:
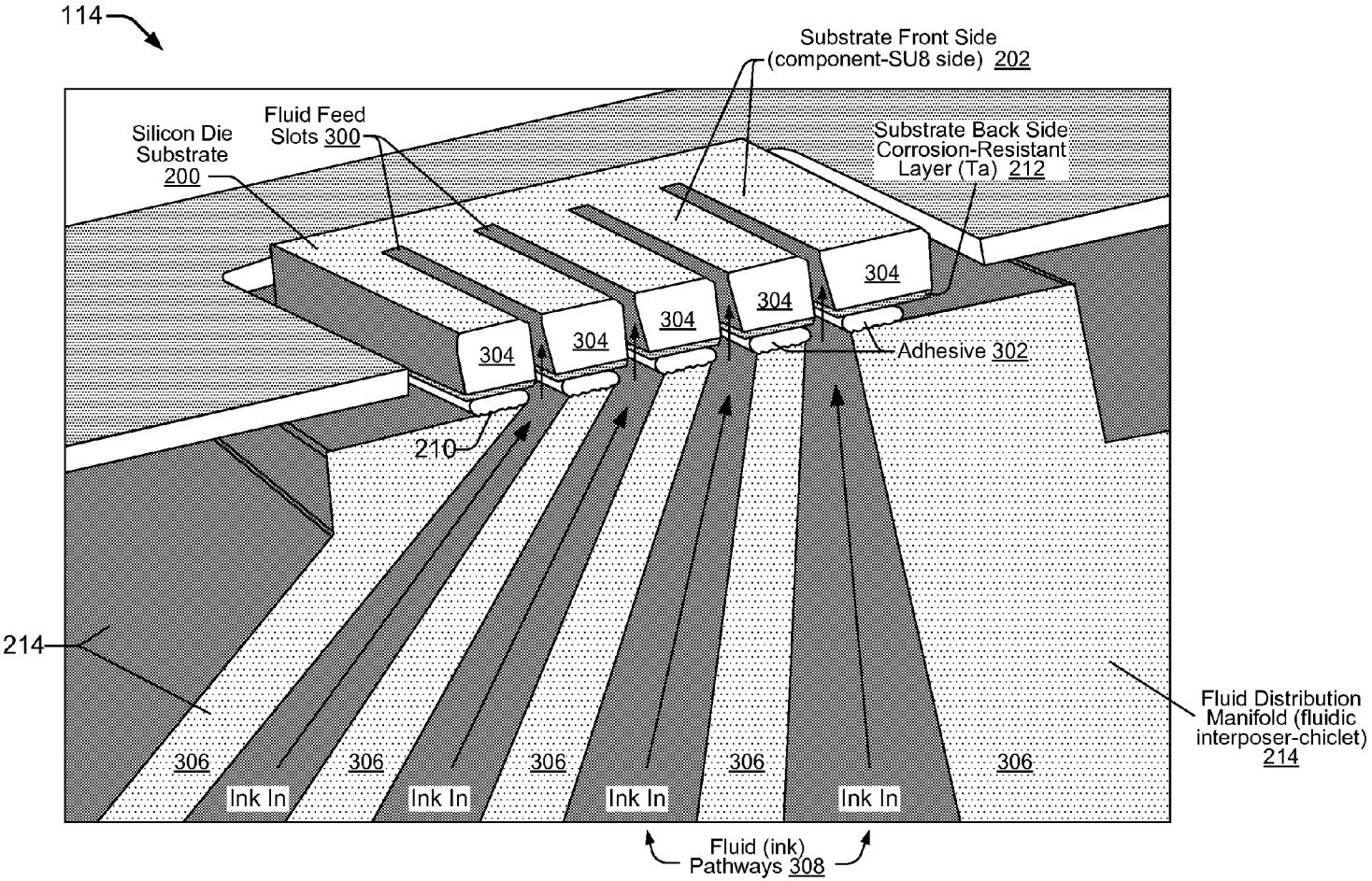
FIG. 4 shows a perspective view of a die substrate adhered to a fluid distribution manifold (i.e., a plastic fluidic interposer, or chiclet) in a printhead fluid ejection device, according to an embodiment.

FIGS. 3 and 4 show cross-sectional and perspective views, respectively, of a die substrate 200 adhered to a fluid distribution manifold 214 (i.e., a plastic fluidic interposer, or chiclet) in a printhead 114, according to embodiments of the disclosure. As shown in FIGS. 3 and 4, the printhead 114 is adhered to the fluid distribution manifold 214 by an adhesive 302 at the back side 204 of the die substrate 200. More specifically, die ribs 304 formed in the die substrate 200 during etching of the fluid feed slots 300 are adhered to corresponding manifold ribs 306 of the fluid distribution manifold 214 through bondline adhesion joints formed between adhesive 302 and the corrosion-resistant tantalum layer 212 of the substrate 200. Adhesive 302 is applied onto the fluid distribution manifold 214 by jetting adhesive, needle dispense or application of adhesive strips. Adhesive 302 provides a hermetic seal both between adjacent ink feed slots and to the exterior at the interface (adhesive joints) of fluid distribution manifold 214 and the die ribs 304 in the silicon die substrate 200.

During normal operation, an ink delivery system (see FIG. 1) supplies ink to the fluid pathways 308 of fluid distribution manifold 214. As shown in FIG. 4, the ink flows from the fluid distribution manifold 214 pathways 308 into the fluid feed slots 300 of the die substrate 200, and then into firing chambers on the front side 202 of the substrate 200 where it is ejected through nozzles 116 as ink droplets (chambers and nozzles not shown). The adhesive 302 and tantalum layer 212 are in continuous contact with ink. Despite the potentially corrosive effects of some types of inks that may be used in printhead 114, the tantalum layer 212 resists corrosion and etching that might otherwise degrade the adhesive bondline/joint formed between each adhesive 302 and the tantalum layer 212. Thus, while the tantalum layer 212 promotes adhesion of the fluid distribution manifold 214 to the substrate 200, the tantalum layer 212 increases the reliability of the adhesive joint and/or enables a reduction in the width of the adhesive 302 between the substrate die ribs 304 and manifold ribs 306.

Figure 5:
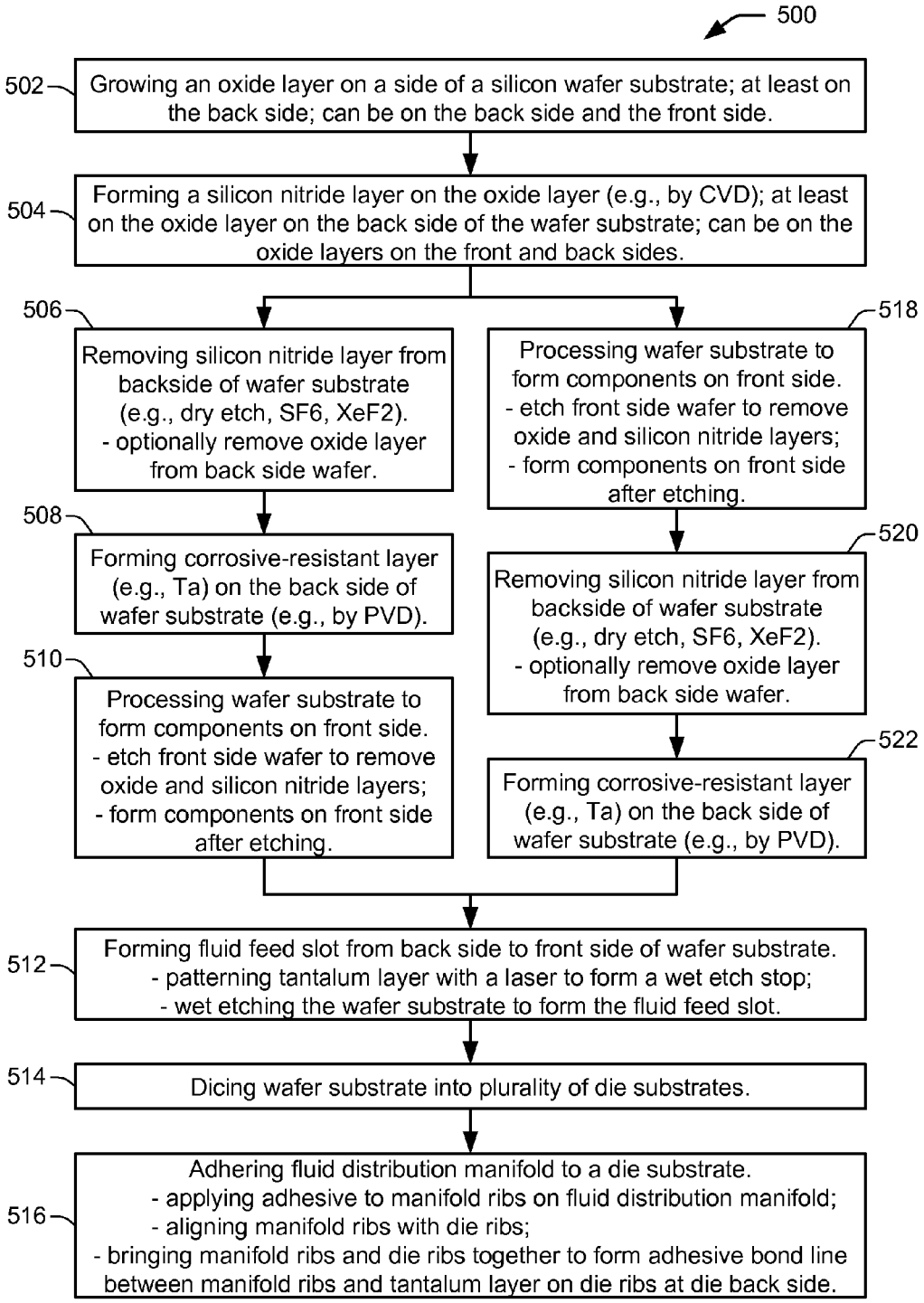
FIG. 5 shows a flowchart of an example method of fabricating a fluid ejection device, such as a printhead, according to an embodiment.
Figure 6:
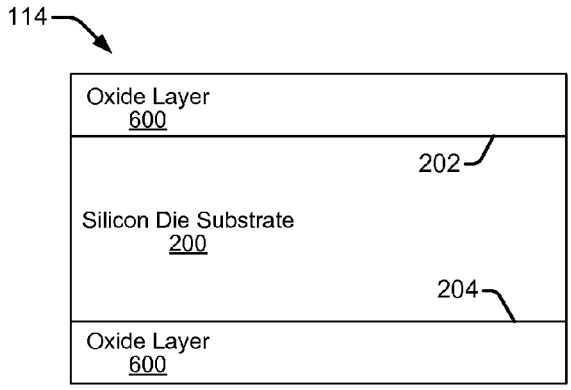
FIG. 6 shows a portion of a resulting fluid ejection device after growing oxide layers on both the back side and front side of a wafer substrate, according to an embodiment.

FIG. 5 shows a flowchart of an example method 500 of fabricating a fluid ejection device 114 (e.g., a printhead), according to an embodiment of the disclosure. Method 500 is associated with the embodiments discussed herein with respect to FIGS. 1-4 and FIGS. 6-10. Method 500 begins at block 502 with growing an oxide (e.g., silicon dioxide, SiO2) on a side of a silicon wafer substrate 200 (die substrate 200) by thermal oxidation, for example. The oxide (SiO2) is at least grown on the back side 204 of the silicon wafer substrate 200 but can also be grown on both the back side 204 and the front side 202 of the substrate 200. FIG. 6 shows a portion of the resulting fluid ejection device 114 after growing oxide layers 600 on both the back side 204 and front side 202, according to an embodiment of the disclosure.

Figure 7:
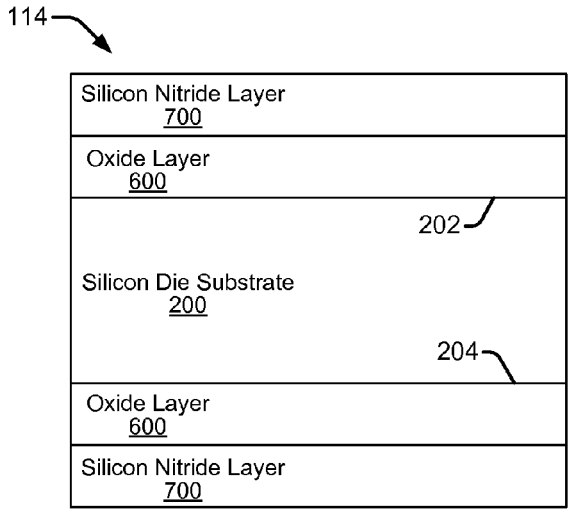
FIG. 7 shows a portion of a resulting fluid ejection device after forming silicon nitride layers on oxide layers on both the back side and front side of a wafer substrate, according to an embodiment.

The method 500 continues at block 504 with forming a silicon nitride layer (SiN) on the oxide layer (e.g., by chemical vapor deposition, CVD). The silicon nitride layer is at least formed on the back side oxide layer but can also be formed on both the back side and front side oxide layers. FIG. 7 shows a portion of the resulting fluid ejection device 114 after forming silicon nitride layers 700 on oxide layers 600 on both the back side 204 and front side 202 of the wafer substrate 200, according to an embodiment of the disclosure.

Figure 8:
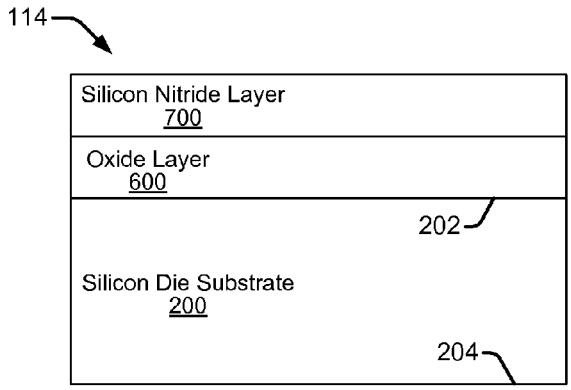
FIG. 8 shows a portion of a resulting fluid ejection device after removing silicon nitride and oxide layers from the back side of the wafer substrate, according to an embodiment.

In one implementation of the method 500, after forming a silicon nitride layer (SiN) on the oxide layer (SiO2), the SiN layer can be removed from the back side 204 of the wafer substrate 200, as shown at block 506. A dry etch process using SF6 (Sulfur hexafluoride) or XeF2 (Xenon Difluoride), for example, can be employed to remove the SiN layer. In another implementation, the SiO2 layer is also removed from the back side of the wafer substrate 200. The backside SiN and SiO2 layers can be removed in a wafer-thinning backgrind process that reduces the thickness of the wafer substrate 200. FIG. 8 shows a portion of the resulting fluid ejection device 114 after removing the silicon nitride and oxide layers from the back side 204 of the wafer substrate 200, according to an embodiment of the disclosure.

Figure 9:
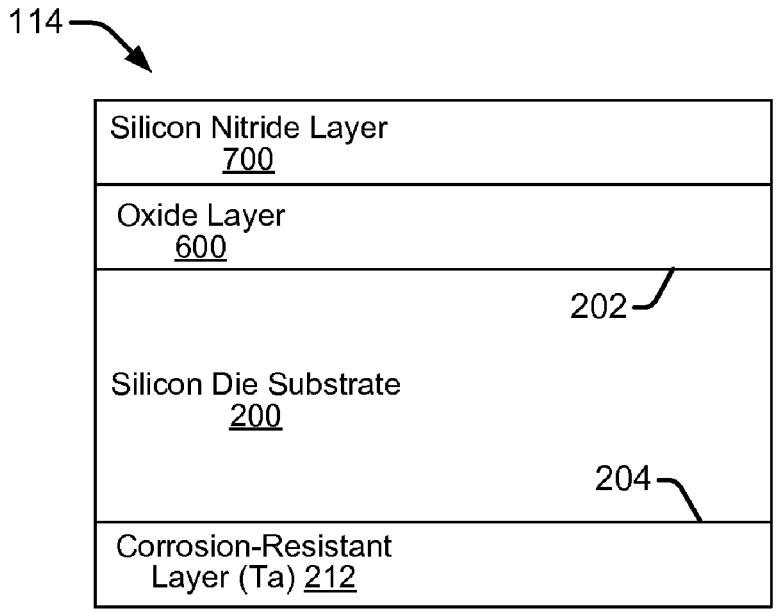
FIG. 9 shows a portion of a resulting fluid ejection device after forming a corrosive-resistant layer on the back side of the wafer substrate, according to an embodiment.

The method 500 continues at block 508 with forming a corrosive-resistant layer such as tantalum (e.g., by physical vapor deposition, PVD) on the back side 204 of the wafer substrate 200. In other implementations, the corrosive-resistant layer may be formed of other appropriate materials that are suitable to withstand the corrosive effects of high-performing, pigment-based inks having increased pH levels, such as different metals, metal oxides, metal nitrides, silicon oxide and carbon fluorine complex polymers. FIG. 9 shows a portion of the resulting fluid ejection device 114 after forming a corrosive-resistant layer on the back side 204 of the wafer substrate 200, according to an embodiment of the disclosure.

Figure 10:
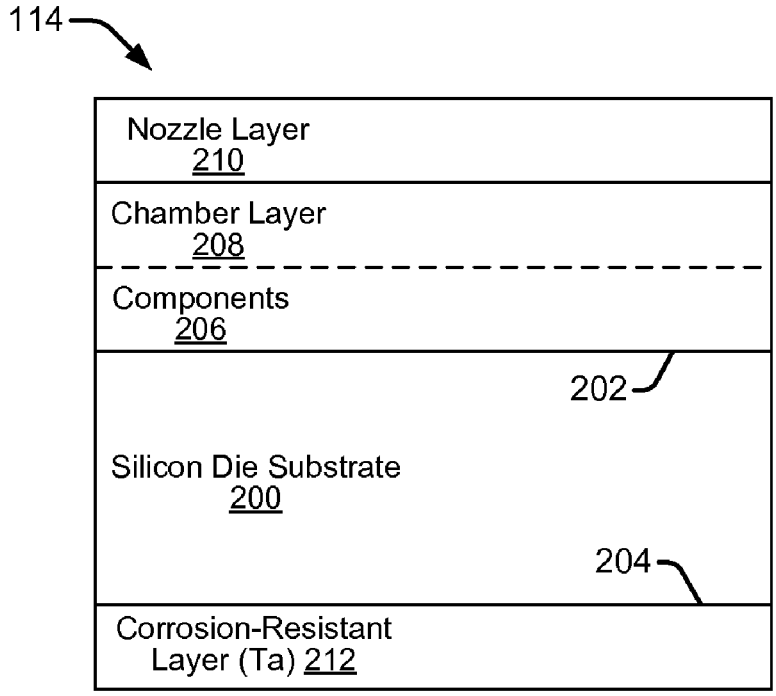
FIG. 10 shows a portion of a resulting fluid ejection device after processing a substrate to form components on the front side of the substrate, according to an embodiment.

At block 510 of method 500, the wafer substrate 200 is processed to form components on the front side 202. The processing includes etching the front side 202 of the wafer substrate 200 to remove oxide 600 and silicon nitride 700 layers, and then forming functional components (e.g., thin-film components) on the front side 202. Functional components formed on the front side 202 can include, for example, thin-film thermal firing resistors, an SU8 layer having chambers that each correspond with a resistor, and a nozzle layer having nozzles that each correspond with a chamber. FIG. 10 shows a portion of the resulting fluid ejection device 114 after processing the substrate 200 to form components on the front side 202, according to an embodiment of the disclosure.

At block 512 of method 500, fluid feed slots 300 (FIGS. 3 and 4) are formed in the substrate 200 from the back side 204 to the front side 202. Formation of the fluid feed slots 300 includes patterning the corrosion-resistant tantalum layer 212 and forming a through slot that extends from the back side of the substrate 200 to the front side. In one implementation the tantalum layer 212 is patterned with a laser) to form a wet-etch stop. Slot formation is completed with a combination of laser micromachining, and wet-etching the wafer substrate 200. In another implementation the tantalum layer 212 is patterned by a dry etch process and the through slot is formed by silicon dry etch (e.g. alternating reactive ion etching with SF6 and C4F8 deposition). In this process, the etching advances through the corrosion-resistant tantalum layer 212 as well as the silicon wafer substrate 200 in a manner that results in there being no tantalum 212 coating within the fluid feed slots. That is, the corrosion-resistant tantalum layer 212 remains on the back side 204 of the substrate 200. The corrosion-resistant tantalum layer 212 is not applied to or otherwise brought into the fluid feed slots 300. Formation of the fluid feed slots 300 results in a corresponding formation of die ribs 304. Fluid feed slots 300 and die ribs 304 formed in the corrosion-resistant tantalum layer 212 and substrate 200 are shown in FIGS. 3 and 4.

The method 500 continues at block 514 with dicing (i.e., cutting or sawing, etc.) the wafer substrate 200 into individual die substrates 200. At block 516 of method 500, a fluid distribution manifold 214 is adhered to a die substrate 200. Adhering the fluid distribution manifold to the die substrate includes applying an adhesive (i.e., jetting adhesive, needle dispense application of adhesive or application of a strip of adhesive) to manifold ribs 306 on the fluid distribution manifold 214, aligning the manifold ribs 306 with corresponding die ribs 304, and bringing the manifold ribs 306 and die ribs 304 together to form adhesive bond lines between the manifold ribs 306 and the tantalum layer 212 that covers the die ribs 304 at the back side 204 of the die substrate 200. FIG. 2, discussed above, shows a portion of the resulting fluid ejection device 114 after adhering the fluid distribution manifold 214 to the die substrate 200, according to an embodiment of the disclosure.

In an alternate implementation of the method 500 of fabricating a fluid ejection device 114, after forming a silicon nitride layer (SiN) on the oxide layer as shown at block 504, the wafer substrate 200 is processed at block 518 to form components on the front side 202, in a manner the same as or similar to that discussed with regard to block 510. Accordingly, the processing includes etching the front side 202 of the wafer substrate 200 to remove oxide 600 and silicon nitride 700 layers, and then forming functional components (e.g., thin-film components) on the front side 202. Functional components formed on the front side 202 can include, for example, thin-film thermal firing resistors, an SU8 layer having chambers that each correspond with a resistor, and a nozzle layer having nozzles that each correspond with a chamber.

In the alternate implementation of method 500, after processing the substrate 200 to form components, at block 520 the silicon nitride (SiN) layer can be removed from the back side 204 of the wafer substrate 200, in a manner the same as or similar to that discussed regarding block 506. Accordingly, a dry etch process using SF6 (Sulfur hexafluoride) or XeF2 (Xenon Difluoride), for example, can be employed to remove the silicon nitride layer. In one implementation, the SiO2 layer is also removed from the back side of the wafer substrate 200. The backside SiN and SiO2 layers can be removed in a wafer-thinning backgrind process that reduces the thickness of the wafer substrate 200.

In the alternate implementation of method 500, after removing the silicon nitride layer, at block 522 of the fabrication method 500 continues with forming a corrosive-resistant layer such as tantalum in a manner the same as or similar to that discussed with regard to block 508. Thus, the corrosive-resistant layer can be formed (e.g., by physical vapor deposition, PVD) on the back side 204 of the wafer substrate 200. In other implementations, the corrosive-resistant layer may be formed of other appropriate materials that are suitable to withstand the corrosive effects of high-performing, pigment-based inks having increased pH levels, such as different metals, metal oxides, metal nitrides, silicon oxide and carbon fluorine complex polymers.

The method 500 then continues from block 522 as already discussed above, with forming fluid feed slots 300 at block 512.

What is claimed is:

1. A fluid ejection device comprising:

a die including a fluid feed slot that extends from a back side to a front side of the die;

a firing chamber formed on the front side to receive fluid from the feed slot;

a fluid distribution manifold adhered to the back side to provide fluid to the feed slot; and a corrosion-resistant layer coating the back side of the die so as not to extend into the feed slot.

2. A fluid ejection device as in claim 1, further comprising adhesive between the manifold and the corrosion-resistant layer.

3. A fluid ejection device as in claim 2, wherein the adhesive comprises adhesive between manifold ribs and the corrosion-resistant layer on the back sides of corresponding die ribs.

4. A fluid ejection device as in claim 1, wherein the corrosion-resistant layer comprises tantalum.

5. A fluid ejection device as in claim 1, wherein the corrosion-resistant layer is a coating selected from a group of coatings consisting of metals, metal alloys, metal oxides, metal nitrides, silicon carbide, ceramics, dielectrics, silicon oxide, semiconductors, composites, organic and inorganic compounds, polymers and carbon fluorine complex polymers.

6. A fluid ejection device as in claim 1, further comprising:

a nozzle corresponding with the firing chamber; and a thermal resistor ejection element corresponding with the firing chamber to eject fluid drops from the firing chamber through the nozzle.

* * * * *